US008971764B2

(12) United States Patent
Klenkler et al.

(10) Patent No.: US 8,971,764 B2
(45) Date of Patent: Mar. 3, 2015

(54) IMAGE FORMING SYSTEM COMPRISING EFFECTIVE IMAGING APPARATUS AND TONER PAIRING

(71) Applicant: Xerox Corporation, Norwalk, CT (US)

(72) Inventors: Richard A. Klenkler, Oakville (CA); Gregory McGuire, Oakville (CA); Sarah J. Vella, Windsor (CA); Guiqin Song, Milton (CA); Yu Liu, Mississauga (CA); Adrien P. Cote, Clarkson (CA)

(73) Assignee: Xerox Corporation, Norwalk, CT (US)

( * ) Notice: Subject to any disclaimer, the term of this patent is extended or adjusted under 35 U.S.C. 154(b) by 38 days.

(21) Appl. No.: 13/853,970

(22) Filed: Mar. 29, 2013

(65) Prior Publication Data

US 2014/0294443 A1 Oct. 2, 2014

(51) Int. Cl.
*G03G 15/00* (2006.01)
*G03G 21/00* (2006.01)

(52) U.S. Cl.
CPC ..... *G03G 21/0011* (2013.01)
USPC ..... 399/159; 399/252; 399/346; 430/62; 430/108; 430/123.3

(58) Field of Classification Search
USPC ..... 399/159, 252, 253, 343, 350; 430/62, 430/108.6, 123.3
See application file for complete search history.

(56) References Cited

U.S. PATENT DOCUMENTS

| | | | | |
|---|---|---|---|---|
| 3,121,006 | A | 6/1957 | Middleton | |
| 4,286,033 | A | 8/1981 | Neyhart | |
| 4,291,110 | A | 9/1981 | Lee | |
| 4,338,387 | A | 7/1982 | Hewitt | |
| 4,387,980 | A | 6/1983 | Ueno | |
| 4,464,450 | A | 8/1984 | Teuscher | |
| 4,587,189 | A | 5/1986 | Hor | |
| 4,664,995 | A | 5/1987 | Horgan | |
| 4,921,773 | A | 5/1990 | Melnyk | |
| 5,069,993 | A | 12/1991 | Robinette | |
| 5,215,839 | A | 6/1993 | Yu | |
| 5,339,149 | A * | 8/1994 | Lindblad et al. | 399/351 |
| 5,660,961 | A | 8/1997 | Yu | |
| 5,756,245 | A | 5/1998 | Esteghamatian | |
| 5,958,638 | A | 9/1999 | Katayama | |
| 6,103,440 | A * | 8/2000 | Lohr | 430/110.1 |
| 6,897,001 | B2 * | 5/2005 | Mizoe et al. | 430/108.6 |
| 7,285,366 | B2 | 10/2007 | Itami | |

(Continued)

FOREIGN PATENT DOCUMENTS

JP 2005189763 A * 7/2005 ..... G03G 21/18

OTHER PUBLICATIONS

Sako, Electrophotographic Photorecetor unit, Jul. 14, 2005, machine translation.*

*Primary Examiner* — Francis Gray

(74) *Attorney, Agent, or Firm* — Pillsbury Winthrop Shaw Pittman LLP

(57) ABSTRACT

The presently disclosed embodiments relate generally to image forming systems comprising imaging apparatus members and toner compositions. More specifically, the present embodiments relate to an improved BCR xerographic system comprising (1) a cleaning blade comprising a material having a certain Share A Hardness; (2) a photoreceptor having a surface with a specified Young's Modulus and; and (3) a toner lubricant additive. The combined system demonstrates a significant increase an overall service life of the system.

17 Claims, 2 Drawing Sheets

(56) References Cited

U.S. PATENT DOCUMENTS

| | | | | |
|---|---|---|---|---|
| 7,390,604 | B2 * | 6/2008 | Miyakawa et al. | 430/108.3 |
| 7,580,655 | B2 | 8/2009 | Nukada | |
| 7,629,102 | B2 | 12/2009 | Ochi | |
| 7,691,552 | B2 | 4/2010 | Marcello | |
| 7,796,934 | B2 | 9/2010 | Teshigawara | |
| 8,034,525 | B2 | 10/2011 | Matsumoto | |
| 8,170,449 | B2 | 5/2012 | Kami | |
| 2007/0201917 | A1 | 8/2007 | Teshigawara | |
| 2010/0111564 | A1 * | 5/2010 | Yamashita et al. | 399/159 |
| 2012/0189955 | A1 | 7/2012 | Chen | |
| 2013/0078560 | A1 | 3/2013 | Heuft | |
| 2013/0078563 | A1 * | 3/2013 | Nakayama et al. | 430/105 |
| 2013/0260297 | A1 * | 10/2013 | Sugiura | 430/105 |
| 2014/0140731 | A1 * | 5/2014 | Hozumi et al. | 399/252 |
| 2014/0294443 | A1 * | 10/2014 | Klenkler et al. | 399/159 |

* cited by examiner

IMAGE FORMING SYSTEM COMPRISING EFFECTIVE IMAGING APPARATUS AND TONER PAIRING

CROSS-REFERENCE TO RELATED APPLICATIONS

Reference is made to commonly owned and co-pending, U.S. patent application Ser. No. 13/853,976 entitled "Image Forming System" to Richard A. Klenkler et al., electronically filed on Mar. 29, 2013.

BACKGROUND

The presently disclosed embodiments relate generally to image forming systems comprising imaging apparatus members and components, and toner compositions for use with those members and components. Furthermore, the present embodiments relate to toner compositions used with the imaging apparatus members and components to form images. In particular, the present embodiments pertain to a Customer Replaceable Unit (CRU) system having subparts with certain modified properties and used with a specific toner composition which demonstrates dramatic improvements in overall CRU life. The subparts include a high modulus imaging member surface, high hardness cleaning blade and a low surface energy lubricant toner with specific particle size range. The electrophotographic imaging member or photoreceptor comprises an overcoat layer protecting the imaging member surface and a contact type charging device, such as a "bias charge roll" (BCR).

In electrophotography or electrophotographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

The described electrophotographic copying process is well known and is commonly used for light lens copying of an original document. Analogous processes also exist in other electrophotographic printing applications such as, for example, digital laser printing and reproduction where charge is deposited on a charge retentive surface in response to electronically generated or stored images.

To charge the surface of a photoreceptor, a contact type charging device has been used, such as disclosed in U.S. Pat. No. 4,387,980 and U.S. Pat. No. 7,580,655, which are incorporated herein by reference. The contact type charging device, also termed "bias charge roll" (BCR) includes a conductive member which is supplied a voltage from a power source with a D.C. voltage superimposed with an A.C. voltage of no less than twice the level of the D.C. voltage. The charging device contacts the image bearing member (photoreceptor) surface, which is a member to be charged. The outer surface of the image bearing member is charged at the contact area. The contact type charging device charges the image bearing member to a predetermined potential.

Electrophotographic photoreceptors can be provided in a number of forms. For example, the photoreceptors can be a homogeneous layer of a single material, such as vitreous selenium, or it can be a composite layer containing a photoconductive material in a mechanically robust matrix. In addition, the photoreceptor can be layered. Multilayered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

Conventional photoreceptors are disclosed in the following patents, a number of which describe the presence of light scattering particles in the undercoat layers: Yu, U.S. Pat. No. 5,660,961; Yu, U.S. Pat. No. 5,215,839; and Katayama et al., U.S. Pat. No. 5,958,638. The term "photoreceptor" or "photoconductor" is generally used interchangeably with the terms "imaging member." The term "electrophotographic" includes "electrophotographic" and "xerographic." The terms "charge transport molecule" are generally used interchangeably with the terms "hole transport molecule."

To further increase the service life of the photoreceptor, use of overcoat layers has also been implemented to protect photoreceptors and improve performance, such as wear resistance. However, these low wear overcoats are associated with poor image quality due to deletion print defects that are exacerbated in a humid environment. In addition, high torque associated with low wear overcoats under BCR charging also causes severe issues, such as photoreceptor drive motor failure and photoreceptor cleaning blade damage. As a result, use of a low wear overcoat with BCR charging systems is still a challenge, and there is a need to find a way to achieve the life target with overcoat technology in such systems.

SUMMARY

According to aspects illustrated herein, there is provided an image forming system comprising an image forming apparatus for forming images further comprising an imaging member having a charge retentive-surface for developing an electrostatic latent image thereon, wherein a surface of the imaging member has a Young's Modulus of 2 GPa or greater, a charging unit comprising a charging roller disposed within charging distance of the surface of the imaging member, and a cleaning blade for cleaning the surface of the imaging member, wherein the cleaning blade comprises a material having a Shore A Hardness of 76 or greater, and a toner composition for use in the image forming apparatus to form the images further comprising toner parent particles, and one or more additives comprising a lubricating stearate having a mode particle size of about 7 microns or less.

In another embodiment, there is provided an image forming system comprising an image forming apparatus for forming images further comprising an imaging member having a charge retentive-surface for developing an electrostatic latent image thereon, wherein the imaging member comprises a substrate, one or more photoconductive layers disposed on the substrate, and an overcoat layer disposed on the one or more photoconductive layers, wherein a surface of the overcoat layer has a Young's Modulus of 2 GPa or greater, a charging unit comprising a charging roller disposed within charging distance of the surface of the imaging member, and a cleaning blade for cleaning the surface of the imaging member, wherein the cleaning blade comprises a material having a Shore A Hardness of 76 or greater, and a toner composition for use in the image forming apparatus to form the images further comprising toner parent particles, and one or more additives comprising zinc stearate having a mode particle size of about 7 microns or less.

In yet further embodiments, there is provided an image forming system comprising an image forming apparatus for forming images further comprising an imaging member having a charge retentive-surface for developing an electrostatic latent image thereon, wherein a surface of the imaging member has a Young's Modulus of 2 GPa or greater, a charging unit comprising a charging roller disposed within charging distance of the surface of the imaging member, and a cleaning blade for cleaning the surface of the imaging member, wherein the cleaning blade comprises a material having a Shore A Hardness of 76 or greater; and a lubricant additive for lubricating the surface of the imaging member comprising a zinc stearate having a mode particle size 6 microns or less.

BRIEF DESCRIPTION OF THE DRAWINGS

For a better understanding, reference may be made to the accompanying figures.

DETAILED DESCRIPTION

In the following description, reference is made to the accompanying drawings, which form a part hereof and which illustrate several embodiments. It is understood that other embodiments may be used and structural and operational changes may be made without departure from the scope of the present disclosure.

Integration of photoreceptors having overcoat layers into image forming machines using bias charge roll (BCR) charging presents two major challenges. One is reducing the friction between the cleaning blade and photoreceptor surface to a level that is compatible with the nominal torque level of photoreceptor drive motor and photoreceptor cleaning blade mechanical stability and life cycle, and another is mitigating the deletion print defect. In fact, high torque and deletion have always commonly been observed with organic based overcoated photoreceptors in image forming machines using BCR charging. A known trade-off dependence between wear rate and image deletion imposes a limit on photoreceptor overcoat layer wear rate and, therefore, prevents wear rate reduction to reach the low levels required for significant improvement in photoreceptor life. In BCR charging systems, overcoat layers are associated with a trade-off between deletion and photoreceptor wear rate. For example, most organic photoconductor (OPC) materials sets require a certain level of wear rate in order to suppress deletion, thus limiting the life of a photoreceptor.

Figure 1:
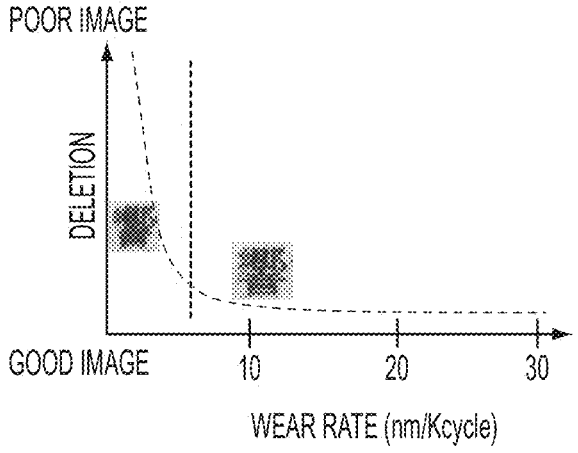
FIG. 1 is a graph illustrating the relationship between photoreceptor wear rate and deletion print defect severity.

FIG. 1 provides a graphical representation of data illustrating the relationship between photoreceptor wear rate and deletion. As can be seen, FIG. 1 indicates that deletion under BCR charging is strictly wear rate dependent. Much effort has been made in finding an organic overcoat formulation that can address these problems directly. However, at this time no such overcoat has been found and currently there are no other known alternatives to mitigate high torque and deletion with overcoated photoreceptors under BCR charging.

One method of addressing the torque and deletion issues is the use of extrinsic continuous application of lubricants to the photoreceptor surface. However, it was found that cleaning blade damage would still occur (generally due to friction between the soft elastomeric blades and hard surface of the low wear photoreceptor) and the CRU cleaning system would fail rather quickly even when using these lubricants with the low wear overcoated photoreceptors. When blade damage occurs, the toner is not cleaned properly and will build up within the cleaning and charging rollers. This build-up eventually begins to print as an obvious localized non-uniformity, at which point the CRU is considered failed.

The present embodiments provide a systems approach to increase CRU life by overcoming the cleaning blade damage issue when incorporating a low wear photoreceptor into machines with Biased Charge Roll (BCR). It has been discovered through extensive experimentation and design efforts that a combination of a cleaning blade with a specific Shore A hardness and a photoreceptor overcoat surface with a specific Modulus along with a low surface energy toner additive with specific particle size will unexpectedly and synergistically work together to prevent cleaning blade damage and cleaning failure and result in significantly increased CRU life.

In particular, the present embodiments provide a much improved BCR xerographic system comprising (1) a cleaning blade comprising a material having a certain Shore A Hardness; (2) a photoreceptor having a surface with a specified Young's Modulus and; and (3) a toner lubricant additive. It was discovered that when a cleaning blade with a high hardness is rubbed against a low wear overcoat with high hardness, the two surfaces are compatible and significantly improve resistance to damage. In combination with specific lubricants to prevent lateral charge migration (LCM) this resistance to damage is synergistically enhanced.

In embodiments, the cleaning blade has a Shore A Hardness of 76 or greater. In further embodiments, the cleaning blade has a Shore A Hardness of from about 60 to about 100 or from about 76 to about 85. Suitable polymeric materials for the elastomeric material of the cleaning blade include, but are not limited, urethanes, butadienes, fluoro-elastomers, fluorosilicone and mixtures thereof. In embodiments, the elastomeric material of the cleaning blade has a thickness of from about 1 to about 3 mm or from about 1.5 to about 2.5 mm or from about 1.8 to about 2.2 mm.

In embodiments, the photoreceptor has a surface with a Young's Modulus of 2 GPa or greater. In further embodiments, the photoreceptor surface has a Young's Modulus of from about 1.5 to about 5.0 GPa or from about 3.0 to about 4.5 GPa. In embodiments, the photoreceptor surface comprises a low wear overcoat. In such embodiments, the overcoat layer may be an inorganic oxide type overcoat layer or a crosslinked organic overcoat layer. An inorganic oxide type overcoat layer formulation may comprise gallium oxide. A crosslinked organic overcoat layer formulation may comprise a hydroxyl-containing charge transport molecule, a polyol polymer binder, and a melamine-based curing agent, which, upon thermal curing, will form a crosslinked overcoat.

In some embodiments, the photoreceptor surface has a water contact angle of 90° or more. In further embodiments, the photoreceptor surface has a water contact angle of from about 70° to about 110° or of from about 90° to about 100° or of from about 85° to about 95°. The water contact angle can be achieved via extrinsic application of lubricants with specific particle sizes, such as those discussed below.

In embodiments, the toner lubricant additive comprises a lubricating stearate. Such stearates are known in the art and include, without limitation, magnesium stearate, calcium stearate, and zinc stearate. In some embodiments, the lubricating stearate comprises zinc stearate. In some embodiments, the lubricating stearate comprises a combination of any of the aforementioned stearates. In embodiments, the additive has a mode particle size of about 6 microns or less. In further embodiments, the additive has a mode particle size of from about 4 to about 7 microns or from about 4 to about 6 microns or from about 5 to about 6 microns. The lubricant additive may be incorporated into a toner to be used with the improved imaging system of the present embodiments or used as a lubricant to be applied to the photoreceptor surface separately.

Figure 2:
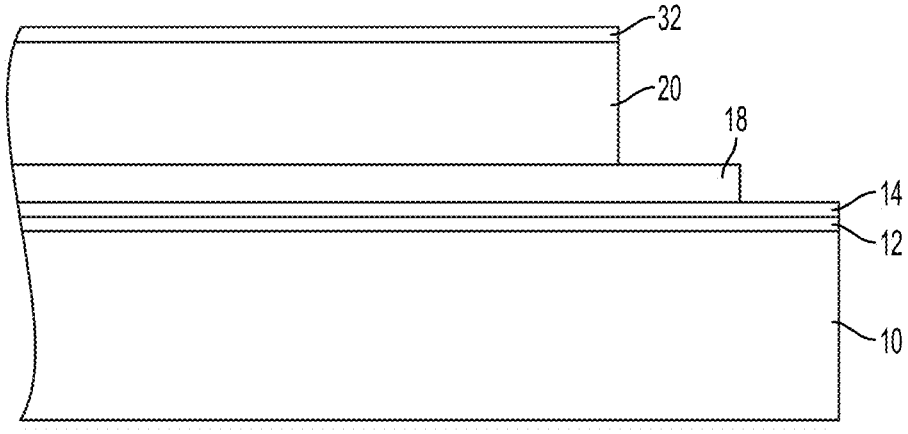
FIG. 2 is a cross-sectional view of an imaging member in a drum configuration according to the present embodiments.

FIG. 2 is an exemplary embodiment of a multilayered electrophotographic imaging member or photoreceptor having a drum configuration. The substrate may further be in a cylinder configuration. As can be seen, the exemplary imaging member includes a rigid support substrate 10, an electrically conductive ground plane 12, an undercoat layer 14, a charge generation layer 18 and a charge transport layer 20. An optional overcoat layer 32 disposed on the charge transport layer may also be included. The rigid substrate may be comprised of a material selected from the group consisting of a metal, metal alloy, aluminum, zirconium, niobium, tantalum, vanadium, hafnium, titanium, nickel, stainless steel, chromium, tungsten, molybdenum, and mixtures thereof. The substrate may also comprise a material selected from the group consisting of a metal, a polymer, a glass, a ceramic, and wood.

The charge generation layer 18 and the charge transport layer 20 forms an imaging layer described here as two separate layers. In an alternative to what is shown in the figure, the charge generation layer may also be disposed on top of the charge transport layer. It will be appreciated that the functional components of these layers may alternatively be combined into a single layer.

Figure 3:
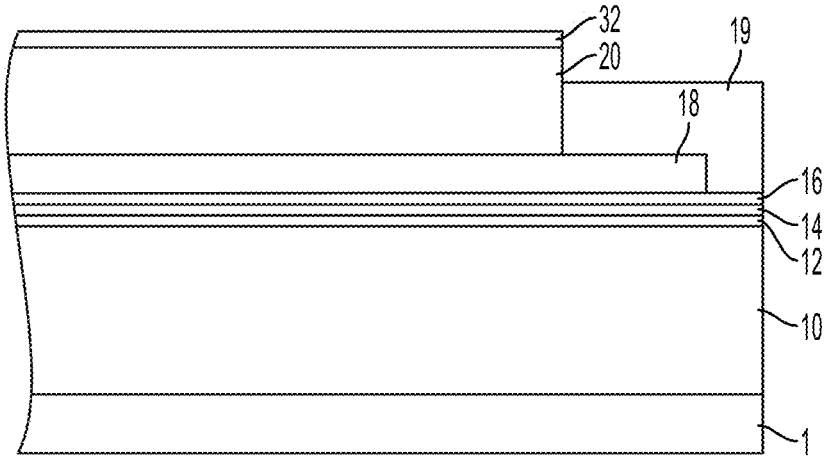
FIG. 3 is a cross-sectional view of an imaging member in a belt configuration according to the present embodiments.

FIG. 3 shows an imaging member or photoreceptor having a belt configuration according to the embodiments. As shown, the belt configuration is provided with an anti-curl back coating 1, a supporting substrate 10, an electrically conductive ground plane 12, an undercoat layer 14, an adhesive layer 16, a charge generation layer 18, and a charge transport layer 20. An optional overcoat layer 32 and ground strip 19 may also be included. An exemplary photoreceptor having a belt configuration is disclosed in U.S. Pat. No. 5,069,993, which is hereby incorporated by reference.

The Overcoat Layer

Other layers of the imaging member may include, for example, an optional over coat layer 32. An optional overcoat layer 32, if desired, may be disposed over the charge transport layer 20 to provide imaging member surface protection as well as improve resistance to abrasion. In embodiments, the overcoat layer 32 may have a thickness ranging from about 0.1 micrometer to about 15 micrometers or from about 1 micrometer to about 10 micrometers, or in a specific embodiment, about 3 micrometers to about 10 micrometers. These overcoating layers typically comprise a charge transport component and an optional organic polymer or inorganic polymer. These overcoating layers may include thermoplastic organic polymers or cross-linked polymers such as thermosetting resins, UV or e-beam cured resins, and the likes. The overcoat layers may further include a particulate additive such as metal oxides including alumina and silica, or low surface energy materials including polytetrafluoroethylene (PTFE), and combinations thereof.

Any known or new overcoat materials may be included for the present embodiments. In embodiments, the overcoat layer may include a charge transport component or a cross-linked charge transport component. In particular embodiments, for example, the overcoat layer comprises a charge transport component comprised of a tertiary arylamine containing substituent capable of self cross-linking or reacting with a polymer resin to form a cured composition. Specific examples of charge transport component suitable for overcoat layer comprise the tertiary arylamine with a general formula of

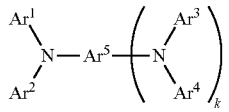

wherein $Ar^1$, $Ar^2$, $Ar^3$, and $Ar^4$ each independently represents an aryl group having about 6 to about 30 carbon atoms, $Ar^5$ represents aromatic hydrocarbon group having about 6 to about 30 carbon atoms, and k represents 0 or 1, and wherein at least one of $Ar^1$, $Ar^2$, $Ar^3$ $Ar^4$, and $Ar^5$ comprises a substituent selected from the group consisting of hydroxyl (—OH), a hydroxymethyl (—$CH_2OH$), an alkoxymethyl (—$CH_2OR$, wherein R is an alkyl having 1 to about 10 carbons), a hydroxylalkyl having 1 to about 10 carbons, and mixtures thereof. In other embodiments, $Ar^1$, $Ar^2$, $Ar^3$, and $Ar^4$ each independently represent a phenyl or a substituted phenyl group, and $Ar^5$ represents a biphenyl or a terphenyl group.

Additional examples of charge transport component which comprise a tertiary arylamine include the following:

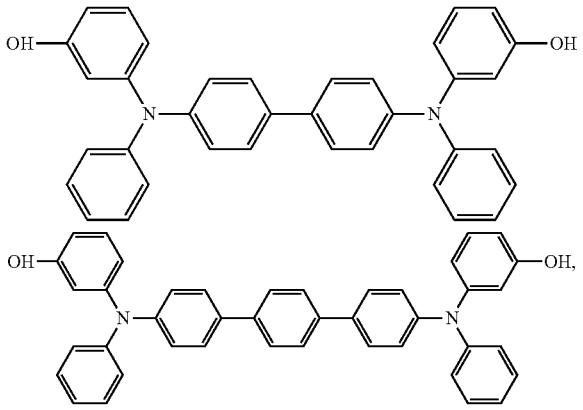

-continued

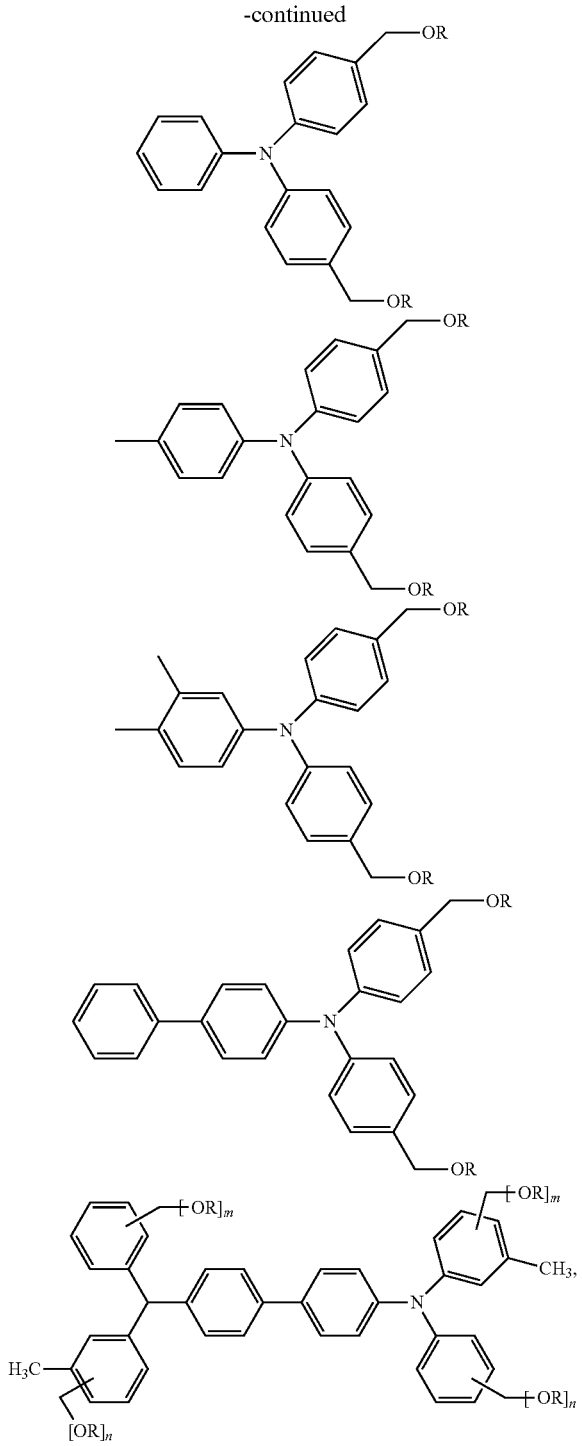

and the like, wherein R is a substituent selected from the group consisting of hydrogen atom, and an alkyl having from 1 to about 6 carbons, and m and n each independently represents 0 or 1, wherein m+n>1. In specific embodiments, the overcoat layer may include an additional curing agent to form a cured, crosslinked overcoat composition. Illustrative examples of the curing agent may be selected from the group consisting of a melamine-formaldehyde resin, a phenol resin, an isocyalate or a masking isocyalate compound, an acrylate resin, a polyol resin, or mixtures thereof. In embodiments, the crosslinked overcoat composition has an average modulus ranging from about 3 GPa to about 5 GPa, as measured by nano-indentation method using, for example, nanomechanical test instruments manufactured by Hysitron Inc. (Minneapolis, Minn.).

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, a metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of different configurations, such as for example, a plate, a cylinder, a drum, a scroll, an endless flexible belt, and the like. In the case of the substrate being in the form of a belt, as shown in FIG. 2, the belt can be seamed or seamless. In embodiments, the photoreceptor herein is in a drum configuration.

The thickness of the substrate 10 depends on numerous factors, including flexibility, mechanical performance, and economic considerations. The thickness of the support substrate 10 of the present embodiments may be at least about 500 micrometers, or no more than about 3,000 micrometers, or be at least about 750 micrometers, or no more than about 2500 micrometers.

An exemplary substrate support 10 is not soluble in any of the solvents used in each coating layer solution, is optically transparent or semi-transparent, and is thermally stable up to a high temperature of about 150° C. A substrate support 10 used for imaging member fabrication may have a thermal contraction coefficient ranging from about $1\times10^{-5}$ per ° C. to about $3\times10^{-5}$ per ° C. and a Young's Modulus of between about $4.5\times10^{5}$ PSI (3 GPa) and about $7.5\times10^{5}$ (5 GPa).

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino) titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,338,387, 4,286,033 and 4,291,110.

General embodiments of the undercoat layer may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The hole blocking layer should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The hole blocking layers that contain metal oxides such as zinc oxide, titanium oxide, or tin oxide, may be thicker, for example, having a thickness up to about 25 micrometers. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Charge Generation Layer

The charge generation layer 18 may thereafter be applied to the undercoat layer 14. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the charge generation layer 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the charge generation layer 18 may have a thickness of at least about 0.1 μm, or no more than about 2 μm, or of at least about 0.2 μm, or no more than about 1 μm. These embodiments may be comprised of chlorogallium phthalocyanine or hydroxygallium phthalocyanine or mixtures thereof. The charge generation layer 18 containing the charge generating material and the resinous binder material generally ranges in thickness of at least about 0.1 μm, or no more than about 5 μm, for example, from about 0.2 μm to about 3 μm when dry. The charge generation layer thickness is generally related to binder content. Higher binder content compositions generally employ thicker layers for charge generation.

The Charge Transport Layer

In a drum photoreceptor, the charge transport layer comprises a single layer of the same composition. As such, the charge transport layer will be discussed specifically in terms of a single layer 20, but the details will be also applicable to an embodiment having dual charge transport layers. The charge transport layer 20 is thereafter applied over the charge generation layer 18 and may include any suitable transparent organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

The layer 20 is normally transparent in a wavelength region in which the electrophotographic imaging member is to be used when exposure is affected there to ensure that most of the incident radiation is utilized by the underlying charge generation layer 18. The charge transport layer should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the charge generation layer 18 is sandwiched between the substrate and the charge transport layer 20. The charge transport layer 20 in conjunction with the charge generation layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The high mobility charge transport component may comprise small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which layer generally is of a thickness of from about 5 to about 75 micrometers, and more specifically, of a thickness of from about 15 to about 40 micrometers. Examples of charge transport components are aryl amines of the following formulas/structures:

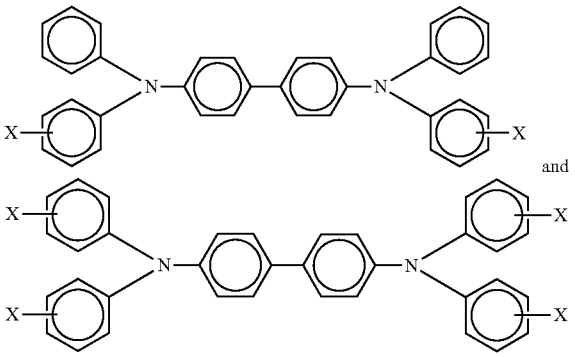

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

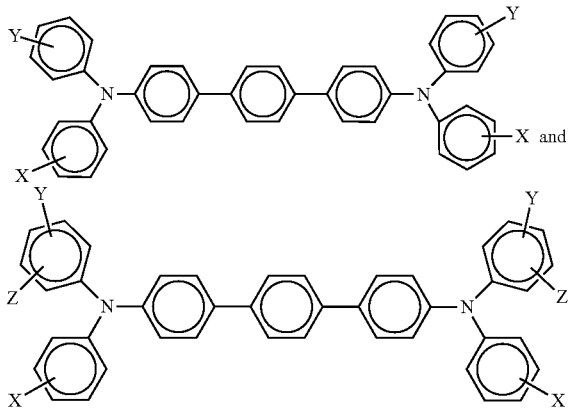

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 μm, or no more than about 40 μm.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 3 to about 8 weight percent.

The charge transport layer should be an insulator to the extent that the electrostatic charge placed on the hole transport layer is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

In addition, in the present embodiments using a belt configuration, the charge transport layer may consist of a single pass charge transport layer or a dual pass charge transport layer (or dual layer charge transport layer) with the same or different transport molecule ratios. In these embodiments, the dual layer charge transport layer has a total thickness of from about 10 μm to about 40 μm. In other embodiments, each layer of the dual layer charge transport layer may have an individual thickness of from 2 μm to about 20 μm. Moreover, the charge transport layer may be configured such that it is used as a top layer of the photoreceptor to inhibit crystallization at the interface of the charge transport layer and the overcoat layer. In another embodiment, the charge transport layer may be configured such that it is used as a first pass charge transport layer to inhibit microcrystallization occurring at the interface between the first pass and second pass layers.

Any suitable and conventional technique may be utilized to form and thereafter apply the charge transport layer mixture to the supporting substrate layer. The charge transport layer may be formed in a single coating step or in multiple coating steps. Dip coating, ring coating, spray, gravure or any other drum coating methods may be used.

Drying of the deposited coating may be effected by any suitable conventional technique such as oven drying, infrared radiation drying, air drying and the like. The thickness of the charge transport layer after drying is from about 10 μm to about 40 μm or from about 12 μm to about 36 μm for optimum photoelectrical and mechanical results. In another embodiment the thickness is from about 14 μm to about 36 μm.

The Adhesive Layer

An optional separate adhesive interface layer may be provided in certain configurations, such as for example, in flexible web configurations. In the embodiment illustrated in FIG. 1, the interface layer would be situated between the blocking layer 14 and the charge generation layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generator layer 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Solvents may include tetrahydrofuran, toluene, monochlorbenzene, dichloromethane, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra-red radiation drying, air drying, and the like.

The adhesive interface layer may have a thickness of at least about 0.01 micrometers, or no more than about 1 micrometers after drying. In embodiments, the dried thickness is from about 0.03 micrometers to about 0.07 micrometer.

The Ground Strip

The ground strip may comprise a film forming polymer binder and electrically conductive particles. Any suitable electrically conductive particles may be used in the electrically conductive ground strip layer 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness of at least about 7 micrometers, or no more than about 42 micrometers, or of at least about 14 micrometers, or no more than about 27 micrometers.

The Anti-Curl Back Coating Layer

The anti-curl back coating 1 may comprise organic polymers or inorganic polymers that are electrically insulating or slightly semi-conductive. The anti-curl back coating provides flatness and/or abrasion resistance.

Anti-curl back coating 1 may be formed at the back side of the substrate 2, opposite to the imaging layers. The anti-curl back coating may comprise a film forming resin binder and an adhesion promoter additive. The resin binder may be the same resins as the resin binders of the charge transport layer discussed above. Examples of film forming resins include polyacrylate, polystyrene, bisphenol polycarbonate, poly(4,4'-isopropylidene diphenyl carbonate), 4,4'-cyclohexylidene diphenyl polycarbonate, and the like. Adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl back coating is at least about 3 micrometers, or no more than about 35 micrometers, or about 14 micrometers.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Evaluation of Exemplary Image Forming Systems

Several combinations of photoreceptor, cleaning blade, and lubricants were xerographically cycled in a Xerox 700 Digital Color Press printer until cleaning failure occurred. Cleaning failure was defined as the number of xerographic cycles until visible print defects due to blade or photoreceptor surface damage occurred. The number of cycles until cleaning failure was then compared between all examples. The specific combinations will be described in more detail below.

As shown in Table 1, the following property measurements were taken and evaluated.

TABLE 1

| | |
|---|---|
| Hardness | Cleaning blade hardness was measured using a Shore A durometer. |
| Modulus | Photoreceptor surface modulus was measured using Nano-indentation. |
| Particle Size | Lubricant particle size was measured using Malvern particle size analyzer. |
| Water Contact Angle | PR surface water contact angle measured using FTA 200 |

Test Methodology

The testing methodology comprised the following steps: (1) continuously cycle CRU by printing standardized target pages in atmospheric conditions where temperature was 28° C. and relative humidity was 85%; (2) every 10,000 cycles print out test print pack and evaluate image quality; and (3) every 10,000 cycles visually inspect photoreceptor surface, BCR, and cleaning foam roller for evidence of toner filming, rings, or dusting.

Results

The results of the tests are illustrated in Table 2 below.

| | Photoreceptor Surface Modulus (GPa) | Cleaning Blade Shore A Hardness | Lubricant-Zinc stearate Mode Particle Size | Photoreceptor Surface Water Contact Angle (degrees) | Number of Cycles until Cleaning Failure |
|---|---|---|---|---|---|
| Comparative Example 1 | 3.4 | 73 | ~10 microns | 90 | 1* |
| Comparative Example 2 | 3.4 | 73 | ~7 microns | 89 | 500° |
| Comparative Example 3 | 3.4 | 73 | ~6 microns | 93 | 90,000 |
| Example 1 | 3.4 | 77 | ~6 microns | 93 | 360,000 |
| Example 2 | 2.29 | 77 | ~6 microns | 93 | 438,000 |
| Example 3 | 4.75 | 77 | ~6 microns | 93 | 600,000 |

*Initial print quality failure due to severe LCM

°Initial print quality failure due to intermittent LCM

Comparative Example 1 and 2

Both exemplary systems have a photoreceptor surface modulus greater than 2.0 GPa and a measured water contact angle below 90°, and a cleaning blade Shore A hardness less than 76. Both failed at time zero due to poor print quality caused by lateral charge migration.

Comparative Example 3

This exemplary system has a photoreceptor surface modulus greater than 2.0 GPa and a measured water contact angle above 90°, and a cleaning blade Shore A hardness less than 76. The system did not exhibit any visible LCM but failed after only 90,000 cycles due to cleaning blade damage and subsequent toner contamination of the BCR that became visible on the prints.

Examples 1-3

These exemplary systems have a combination of a PR surface modulus greater than 2.0 GPa and a measured water contact angle above 90°, and a cleaning blade Shore A hardness greater than 76. These Examples demonstrate the synergy of the combined system incorporating a cleaning blade with a Shore A hardness greater than 76 with zinc stearate particles having a mode particles size of about 6 microns, in conjunction with a favorable photoreceptor surface modulus.

The results demonstrate that a combination of a photoreceptor surface modulus greater than 2.0 GPa and a measured water contact angle above 90° together with a cleaning blade Shore A hardness greater than 76 facilitates long life CRU operation before cleaning failure. This CRU system provides the use of low wear overcoats with surface modulus above 2.0 GPa to be used in xerographic CRUs for long life operation without cleaning failure.

Various size grades of zinc stearate particles were screened. Commercially available zinc stearates include those having (1) a mode (center of the distribution) particle size of about 10 microns, such as ZnSt-S available from Asahi Denka Kogyo Co., Ltd., (2) a mode particle size of about 7 microns, such as ZnSt-L available from Asahi Denka Kogyo Co., and (3) a mode particle size of about 6 microns, such as ZnFP available from Nippon Oil and Fat Corp. As indicated in Table 2, the highest water contact angles were achieved with ZnFP, the zinc stearate product having a mode particle size of about 6 microns.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An image forming system comprising:

an image forming apparatus for forming images further comprising an imaging member having a charge retentive-surface for developing an electrostatic latent image thereon, wherein a surface of the imaging member has a Young's Modulus of 2 GPa or greater, a charging unit comprising a charging roller disposed within charging distance of the surface of the imaging member, and a cleaning blade for cleaning the surface of the imaging member, wherein the cleaning blade comprises a material having a Shore A Hardness of 76 or greater; and a toner composition for use in the image forming apparatus to form the images further comprising
toner parent particles, and
one or more additives comprising a lubricating stearate having a mode particle size of about 7 microns or less and a polymethylmethacrylate having a particle size of from about 0.3 μm to about 1.0 μn;
wherein printed images formed with the image forming system do not exhibit deletion.

2. The system of claim 1, wherein the lubricating stearate comprises zinc stearate.

3. The image forming system of claim 1, wherein the surface of the imaging member has a Young's Modulus of from about 3 to about 4.5 GPa.

4. The image forming system of claim 1, wherein the surface of the imaging member has a water contact angle of 90° or greater.

5. The image forming system of claim 4, wherein the surface of the imaging member has a water contact angle of from about 90° to about 100°.

6. The imaging forming system of claim 1, wherein the cleaning blade comprises a material having a Shore A Hardness of from about 76 to about 85.

7. The image forming system of claim 1, wherein the cleaning blade comprises an elastomeric material selected from the group consisting of urethanes, butadienes, fluoroelastomers, fluorosilicone, and mixtures thereof.

8. The image forming system of claim 1, wherein the zinc stearate has a mode particle size of about 6 microns or less.

9. The image forming system of claim 1, wherein the zinc stearate has a mode particle size of from about 4 to about 7 microns.

10. The image forming system of claim 1, wherein zinc stearate is present in an amount of from about 2.00 weight percent to about 0.01 weight percent by the total weight of the toner composition.

11. The image forming system of claim 1, wherein the zinc stearate is present in a weight ratio to the toner parent particle of from about 2.00:100 to about 0.01:100.

12. The image forming system of claim 1, wherein polymethylmethacrylate is present in an amount of from about 2.00 weight percent to about 0.01 weight percent by the total weight of the toner composition.

13. The image forming system of claim 1, wherein the polymethylmethacrylate is present in a weight ratio to the toner parent particle of from about 2.00:100 to about 0.01:100.

14. An image forming system comprising:
an image forming apparatus for forming images further comprising
an imaging member having a charge retentive-surface for developing an electrostatic latent image thereon, wherein the imaging member comprises:
a substrate,
one or more photoconductive layers disposed on the substrate, and
an overcoat layer disposed on the one or more photoconductive layers, wherein a surface of the overcoat layer has a Young's Modulus of 2 GPa or greater,
a charging unit comprising a charging roller disposed within charging distance of the surface of the imaging member, and
a cleaning blade for cleaning the surface of the imaging member, wherein the cleaning blade comprises a material having a Shore A Hardness of 76 or greater; and
a toner composition for use in the image forming apparatus to form the images further comprising
toner parent particles, and
one or more additives comprising zinc stearate having a mode particle size of about 7 microns or less and a polymethylmethacrylate having a particle size of from about 0.3 μm to about 1.0 μm.

15. The image forming system of claim 14, wherein the overcoat layer comprises a crosslinked organic matrix.

16. The image forming system of claim 14, wherein the overcoat layer comprises an inorganic oxide.

17. An image forming system comprising:
an image forming apparatus for forming images further comprising
an imaging member having a charge retentive-surface for developing an electrostatic latent image thereon, wherein a surface of the imaging member has a Young's Modulus of 2 GPa or greater,
a charging unit comprising a charging roller disposed within charging distance of the surface of the imaging member, and
a cleaning blade for cleaning the surface of the imaging member, wherein the cleaning blade comprises a material having a Shore A Hardness of 76 or greater; and
a lubricant additive for lubricating the surface of the imaging member comprising a zinc stearate having a mode particle size 6 microns or less; and
a toner additive comprising a polymethylmethacrylate having a particle size of from about 0.3 μm to about 1.0 μm.

* * * * *